United States Patent [19]

Nicholson

[11] 4,240,559

[45] Dec. 23, 1980

[54] PROTECTIVE DEVICE FOR CAR COUPLER

[76] Inventor: Harry W. Nicholson, R.D. #4, Box 283, Rte. 66S, Apollo, Pa. 15613

[21] Appl. No.: 28,692

[22] Filed: Apr. 18, 1979

[51] Int. Cl.[3] ..... B61G 7/14

[52] U.S. Cl. ..... 213/1 R; 105/458

[58] Field of Search ..... 213/1 R, 220; 105/458, 105/459, 3, 4 R, 8 R

[56] References Cited

U.S. PATENT DOCUMENTS 3,025,973 3/1962 Shafer ..... 213/1 R

*Primary Examiner*—Richard A. Bertsch

*Attorney, Agent, or Firm*—James Irwin

[57] ABSTRACT

A protective device is provided for a coupler of the type such as used on railroad cars, the coupler having two members the ends of which have a generally C-shaped configuration and which engage each other for purposes of hitching or towing cars, the protective device comprising a cover member designed to be placed over the coupler and adapted to prevent foreign materials from engaging the members of the coupler and impeding operation thereof, and a clamping device attached to the cover, the clamping device designed to fixedly engage at least one of the members of the coupler for purposes of maintaining the cover member on the coupler.

4 Claims, 3 Drawing Figures

FIG. 1.
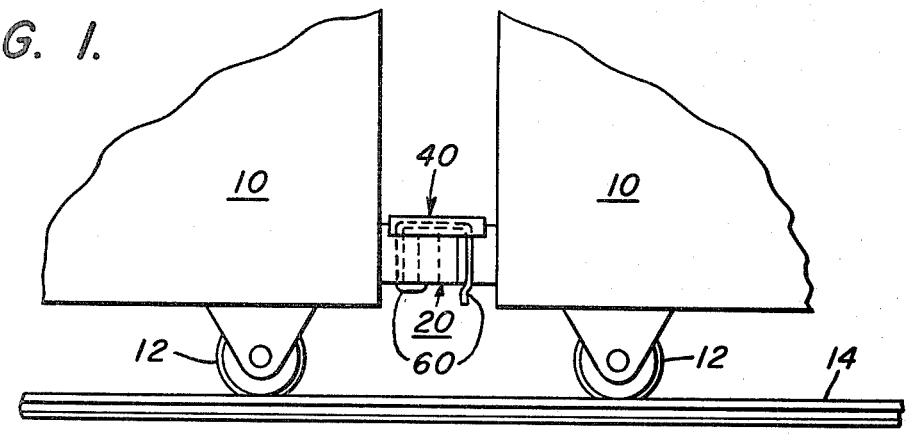
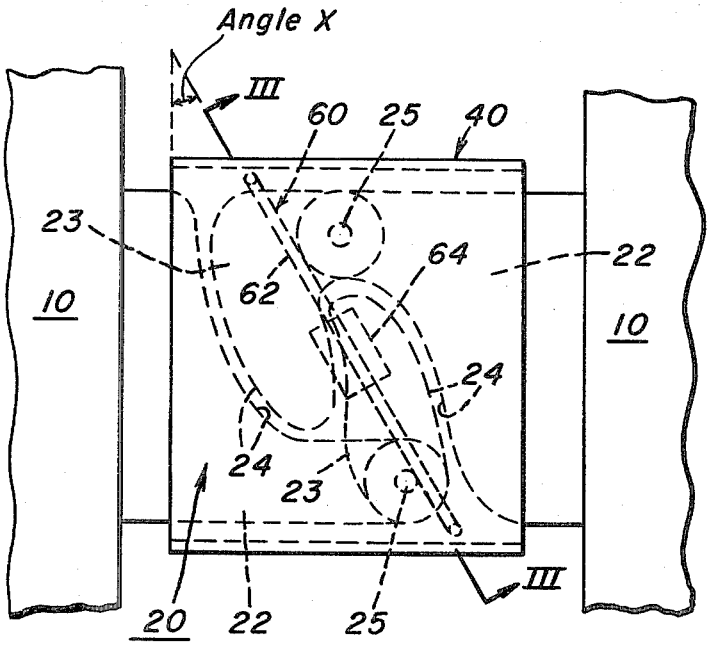
FIG. 2.
FIG. 3.
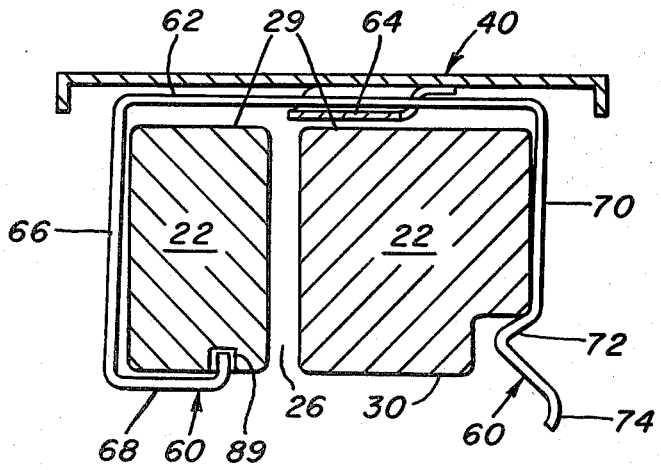

PROTECTIVE DEVICE FOR CAR COUPLER

INTRODUCTION

This invention relates to a coupler and more particularly it relates to a protective device for a coupler such as used for coupling or connecting railroad cars.

Couplers can malfunction when splashed with molten metal such as encountered in steel plants, for instance. That is, when car couplers are accidently splashed with molten metal, the couplers can become inoperative as a result of metal freezing or solidifying thereon. As a result, the couplers are not free to move or function as designed when cars move around a curve, for example. The result of molten metal fusing on the coupler can result in damage to rails in addition to excessive wear of car wheels and wheel bearings. Furthermore, it will be understood that couplers frozen or welded together in this manner can greatly interfer with coupling and uncoupling cars. Such interference with coupling is best avoided since it can lead to personal injury because of the extra time spent coupling or uncoupling cars. To repair the damaged couplers by removing fused matal can require considerable grinding which at best is only a temporary solution which can be very expensive and time consuming. Thus, it will be seen that there is a great need for a device which will obviate these problems.

The present invention solves the aforegoing problems by providing a device which prevents materials such as molten metal from solidifying or freezing on the coupling members and ensures their continued operation without fear of binding.

SUMMARY OF THE INVENTION

An object of the present invention is to provide a protective device for a coupler.

Another object of the invention is to provide a protective device which prevents molten metal and the like from depositing and solidifying on couplers such as used on railroad cars.

A further object of the invention is to provide a protective device for couplers such as used on railroad cars, the device while mounted on the coupling member permitting coupling or uncoupling cars.

Yet another object of the invention is to provide a protective device for couplers having a clamping means which releasably attaches to the coupler.

These and other objects will become apparent from the drawings, specification and claims appended hereto.

In accordance with the objects of the invention, there is provided a protective device for a coupler of the type such as used on railroad cars, the coupler having two members the ends of which have a generally C-shaped configuration and which engage each other for purposes of towing or moving cars, the protective device comprising a cover member designed to be placed over said coupler and adapted to prevent foreign materials from engaging the members of the coupler and impeding operation thereof. In addition, the protective device includes clamping means attached to the cover member, the clamping means designed to fixedly engage at least one of the members of the coupler for purposes of maintaining said cover member over the coupler. In a preferred embodiment, the clamping means is rotatably mounted on the cover member and releasably attaches or secures the cover on the coupler by spring action.

BRIEF DESCRIPTION OF THE DRAWINGS

FIG. 1 is a side elevational view schematically illustrating the protective device mounted on a coupler joining two railroad vehicles.

FIG. 2 is a top plan view schematically showing the protective device mounted on a coupler joining to vehicles.

FIG. 3 is a cross-section of the protective device through the line III—III of FIG. 2.

DETAILED DESCRIPTION OF THE PREFERRED EMBODIMENTS

Referring now to FIG. 1, there is provided to illustrate the use of the present invention, a partial view of railroad cars 10 with wheels 12 located or positioned on rail 14. The cars are connected by a coupler 20, and protective device or shield referred to generally as 40 covers coupler 20. By reference to FIG. 2, it will be noted that coupler 20, typical of the type to which the present invention has application comprises two hooked or C-shaped members 22. The members are shown in meshed or coupled position exemplifying conditions when cars are connected. The members can have a portion 23 thereof, which can swivel or rotate about pin 25 for purposes of hitching or unhitching cars. Portion or section 23, of the coupling members, may be operated remotely by lever (not shown). Cover member 40 of the protective device is shown covering interfaces 24 of members 22. It will be understood, of course, that the coupler 20 as sketched in FIG. 2 is merely illustrative of coupling devices and the space shown between interfaces 24 of members 22 is merely shown for purposes of illustrating the invention and undoubtedly in some cases departures therefrom will be experienced without interfering with the application of the present invention. In any event, it will be noted from FIG. 2 that cover member 40 essentially protects interface 24 of each coupling member 22, preventing foreign materials, for example, molten metal from depositing or freezing in or bridging the space defined by interface 24 of each coupling member 22. It will be understood that while cover member 40 is shown as having a generally square configuration, other configurations which prevent materials from entering between interfaces 24 of the coupling members are contemplated with in the purview of the invention.

By reference to the Figures, it will be observed that means 60 is provided for clamping or maintaining cover member or protective shield 40 over the coupler and in protective relationship to the space defined by interface 24 of member 22. It will be understood that it is important that the cover member be maintained in a fixed position over the junction of coupler members 22. That is, it is important that cover member 40 be suitably mounted to prevent its sliding forwards or backwards on the coupler and exposing junction 26 between coupling members 22. Yet, it will be further understood that an important aspect of the invention is that the cover member may be mounted or removed easily and that it does not adversely interfer with coupling and uncoupling cars. Similarily, during coupling or uncoupling, it is important that the protective device be attached sufficiently securely so as to prevent its inadvertently falling from the coupler. Thus it can be seen that an important feature of the invention is providing a protective device which is attached or mounted on the coupling securely to prevent its sliding back and forth and yet it should not be so secure as to adversely or unduly delay or interfer with coupling or uncoupling cars.

In accordance with these features, in a preferred aspect of the invention, the protective device is secured to the coupler with clamping means 60 which releasably secures the device to the coupler and which can maintain it on the coupler even during coupling or uncoupling cars. Furthermore, in the preferred embodiment of the invention, the protective device may be quickly and easily mounted on or removed from the coupler without aid of tools.

Clamping device 60 as illustrated in FIGS. 2 and 3 comprises a rod section 62 mounted more or less substantially parallel to cover member 40 (FIG. 3), with rod section 62 extending across top 29 of coupler members 22. Rod section 62 can be rotatably mounted to the underside of cover member 60 by strap 64. It will be understood that rod section 62 may be mounted on the top side of the cover member; however, such arrangement is less preferred since molten metal solidifying thereon can interfer with its operation.

From FIG. 3 it will be seen that when the cover member is secured to the coupler, clamping device 60 also includes an arm 66 which extends generally downwardly from a plane substantially parallel to the plane of the shield. Arm 66 extends more or less down through the depth of coupling member 22. In the embodiment shown in FIG. 3, arm 66 is provided with a curved portion 68 which projects generally inwardly towards the other coupler member. Curved portion 68 is designed or adapted to grip or anchor itself in opening 89 on the underside of the coupler member.

Clamping device 60 as shown in FIG. 3, also includes a second arm 70 which extends generally downwardly from a plane substantially parallel to the plane of the cover member. Arm 70 also extends more or less downwardly through the depth of the coupler. In the embodiment shown, arm 70 has an elbow section 72 designed to engage underside 30 of the coupler member. In mounting the protective device on the coupler, elbow section 72 snaps on to a recessed area on underside 30. It should be noted that arms 66 and 70 of clamping device 60 are formed so as to provide spring action engagement of the protective device to the coupler. That is, arms 66 and 70 are formed so that they grip the coupler members with a determined amount of force. As noted earlier, the gripping force should be sufficient to prevent the protective device from sliding back and forth or otherwise moving on the coupler and leaving juncture 26 exposed to molten metal and the like. It will be noted that arm 70 is provided with a handle 74 for ease of disengagement of the clamping device.

From FIGS. 1 and 2 it will be noted that the clamping device is designed and attached to the cover member, so as to grip the coupler in a preferred orientation. That is, it will be observed particularly in FIG. 2 that rod section 62 of the clamping device is mounted at an angle in the range of about 15° to 30° as measured against a plane perpendicular with respect to the general direction of travel of the cars. With respect to FIG. 2, the angle is shown and referred to as angle X. A typical angle which is suitable for purposes of the present invention is in the range of 20° to 25°. Having rod sections mounted in this manner permits arms 66 and 70 to be positioned slightly into juncture 26 or space between the innerfaces 24 of coupler members 22. Having the clamping device mounted in this manner further provides additional assurance that the shield does not move back and forth on the coupler. It will be noted that rod section 62 may be mounted substantially perpendicular to the direction of travel with curved portion 88 and elbow section offset to form angles substantially as noted.

In the above, it was indicated that the clamping device may be rotatably attached or mounted on the cover member. Having the clamping device mounted in this manner serves to permit controlled movement of the cover member which may result, for example, from an uneven track. Additionally, having the clamping device rotatably mounted in this way makes for greater convenience during shipping or storing.

The cover member may be constructed from any suitable material depending largely on the elements it is likely to encounter. However, when protection is desired from molten metal and the likes, the cover member should be constructed from metal such as 16 guage mild steel, for example. Likewise, the clamping device may be fabricated from suitable steel rod or bar stock. As depicted, the clamping device may be mounted on the shield using a suitable metal strap which may be expeditiously joined to the shield by welding, for example.

While the invention has been described in terms of preferred embodiments, the claims appended hereto are intended to encompass other embodiments which fall within the spirit of the invention.

What is claimed is:

1. A protective device for a car coupler of the type such as used on railroad cars, the coupler having two members the ends of which have a generally C-shaped configuration and which engage each other for purposes of adding and towing a car, the protective shield comprising:

(a) a cover member designed to be placed over said coupler and adapted to prevent foreign materials from depositing on the members of the coupler and impeding operation thereof; and (b) a clamping means rotatably attached to said cover, said clamping means designed to fixedly engage at least one of the members of said coupler for purposes of maintaining said cover member over the coupler.

2. The protective device according to claim 1 wherein the clamping means comprises a metal rod member having a section thereof rotatably mounted on the cover member and having a length which extends substantially across the width of the coupler, the section having arms thereon adapted to grip the coupler.

3. The clamping means according to claim 2 wherein the clamping means has two arms which are designed to extend substantially downwardly from the cover member when the protective device is mounted on a coupler, the arms designed to releasably attach to the coupler.

4. The clamping means according to claim 3 wherein one of the arms has a curved section at the end thereof, designed to protrude into an opening on the underside of the coupler, the other arm having an elbow section towards the end thereof designed to grip a recessed area on the side and towards the underside of the coupler.

* * * * *